US006257944B1

(12) United States Patent
Herrod

(10) Patent No.: US 6,257,944 B1
(45) Date of Patent: Jul. 10, 2001

(54) PADDLE BOARD

(76) Inventor: Phillip G. Herrod, 5044 - 47th St., Drayton Valley, Alberta (CA)

( * ) Notice: Subject to any disclaimer, the term of this patent is extended or adjusted under 35 U.S.C. 154(b) by 0 days.

(21) Appl. No.: 09/654,037

(22) Filed: Sep. 1, 2000

(51) Int. Cl.[7] ..... B63C 9/08
(52) U.S. Cl. ..... 441/130; 441/129
(58) Field of Search ..... 441/129, 130, 441/65; D12/307, 300, 301

(56) References Cited

U.S. PATENT DOCUMENTS

D. 138,753 * 9/1944 Lee .
3,411,166 11/1968 Kimmel .
4,435,165 * 3/1984 Johnson ..... 441/130
5,167,554 * 12/1992 Tager et al. ..... 441/131
5,700,174 12/1997 Churchill et al. .
5,797,779 8/1998 Stewart .
5,820,430 10/1998 Hornsby et al. .
5,879,214 3/1999 Bentley .
6,027,386 2/2000 Hains et al. .

* cited by examiner

*Primary Examiner*—Ed Swinehart
(74) *Attorney, Agent, or Firm*—I. Zborovsky

(57) ABSTRACT

Swimmers have long relied on a variety of flotation devices to enhance their enjoyment of the water. These range from simple, inflatable rafts to surfboards, bodyboards and kneeboards which can be paddled by hand, ridden on the waves or towed behind a power boat. Water activities also bring out an irresistible need to splash one another. The present invention combines the fun of a paddle board, a towed board and a water gun to provide a floating platform for drifting, paddling, being towed or water battles.

13 Claims, 2 Drawing Sheets

PADDLE BOARD

BACKGROUND OF THE INVENTION

1. Field Of The Invention

The present invention relates to water related recreational equipment, especially as it relates to human powered flotation devices. More particularly, the invention comprises a paddle board, ergonomically designed for use in the sitting position, equipped with a cup holder and removable water gun.

2. Description Of The Prior Art

Recreational water boards have taken a variety of forms throughout the years, including those powered by paddling, either by hand or with paddles, and those towed behind a power boat.

U.S. Pat. No. 5,879,214, issued to Harry D. Bentley on Mar. 9, 1999 presents a CONVERTIBLE FLOATING AND SLEDDING TOY which can be converted from a flotation device to a snow sled. In the mode of a snow sled, the toy is equipped with a single, steerable, front mounted ski, with the body of the toy riding on a pair of elongate rails. In the water mode, the ski is replaced with a steerable water jet, connected by a flexible hose to a pool filter discharge nozzle or other pressurized water source, which provides a limited range of forward motion. The flexible hose also provides water to a handlebar mounted water sprayer. In use without the hose, the toy can be towed behind a boat. Unlike Bentley, the present invention is a human powered or towed board with water supplied to its water gun by a pick up tube drawing water from the surface upon which the board is floating.

U.S. Pat. No. 5,820,430, issued to William G. Hornsby, et. al., on Oct. 13, 1998, presents a DUAL AQUAPLANING CRAFT, a towed board designed for two riders in a more or less side by side configuration, the board dividing into two separate surfaces sharing a common bow area. Each portion of the hull has a plurality of longitudinal channel passages for stability and an interchangeable skeg for facilitating cutting maneuvers. The present invention, while designed to be used as a towed board for a single individual also allows for human propulsion and offers a water gun and cup holder for additional activities.

U.S. Pat. No. 5,797,779, issued to Michael A. Stewart on Aug. 25, 1998, presents a BODYBOARD WITH DIFFERENTIATED TOPSKIN, a short board, similar to a surf board, for paddling by hand, but more specifically for riding waves in a prone position. Stewart provides a contoured upper surface which aids a rider to maintain body contact with the board, as well as elbow wells and palm grips to enhance the rider's grip and thus improve control of the board. While Stewart provides for surfing in a prone riding, the present invention is designed paddling or towing in a sitting position and provides for a water gun to provide a wider range of activities.

U.S. Pat. No. 5,700,174, issued to Robert L. Churchill, et. al., on Dec. 23, 1997 presents a KNEEBOARD, an improvement on a hand paddled or towed board designed for use in a kneeling position, which is highly maneuverable. The present invention, on the other hand is intended for use in a sitting position, although kneeling or prone are also possible, and the water gun offers additional activities.

U.S. Pat. No. 3,411,166, issued to Jean A. Kimmel on Nov. 19, 1968 presents an INFLATABLE BOARDING LADDER AND PADDLE COMBINATION, which serves a dual purpose as both a boarding ladder and a life preserver/raft with a tether attached, double ended paddle. While Kimmel is buoyant and can be used as a rudimentary flotation device, the present invention provides more comfort for the user and a wider range of aquatic activities.

U.S. Pat. No. 6.027,386, issued to Nancy Hains, et. al., on Feb. 22, 2000, presents a COMBINATION PADDLE AND WATER SYRINGE, a combination device which allows a paddle to also be used to bail water from a boat or for recreational purpose, as in a floating water fight between crews of different canoes or boats. The present invention provides not only the ability to pump water, but also provides a means of flotation for the user.

None of the above inventions and patents, taken either singly or in combination, is seen to describe the instant invention as claimed.

SUMMARY OF THE INVENTION

Swimmers have long relied on a variety of flotation devices to enhance their enjoyment of the water. These range from simple, inflatable rafts to surfboards, bodyboards and kneeboards which can be paddled by hand, ridden on the waves or towed behind a power boat. Water activities also bring out an irresistible need to splash one another. The present invention combines the fun of a paddle board, a towed board and a water gun to fulfill these needs.

Accordingly, it is a principal object of the invention to provide a paddle board that can be produced in a variety of sizes for use by all ages.

It is another object of the invention to provide a paddle board which be used in a variety of different riding positions.

It is a further object of the invention to provide a paddle board which can be either paddled or towed by a power boat.

Still another object of the invention is to provide a paddle board which has a water gun incorporated into its design.

An additional object of the invention is to provide a paddle board which has a cup holder molded into its surface.

It is again an object of the invention to provide a paddle board which is lightweight.

Yet another object of the invention is to provide a paddle board which is easy to store and transport.

Still another object of the invention is to provide a paddle board with safety and comfort features as in integral part of its design.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
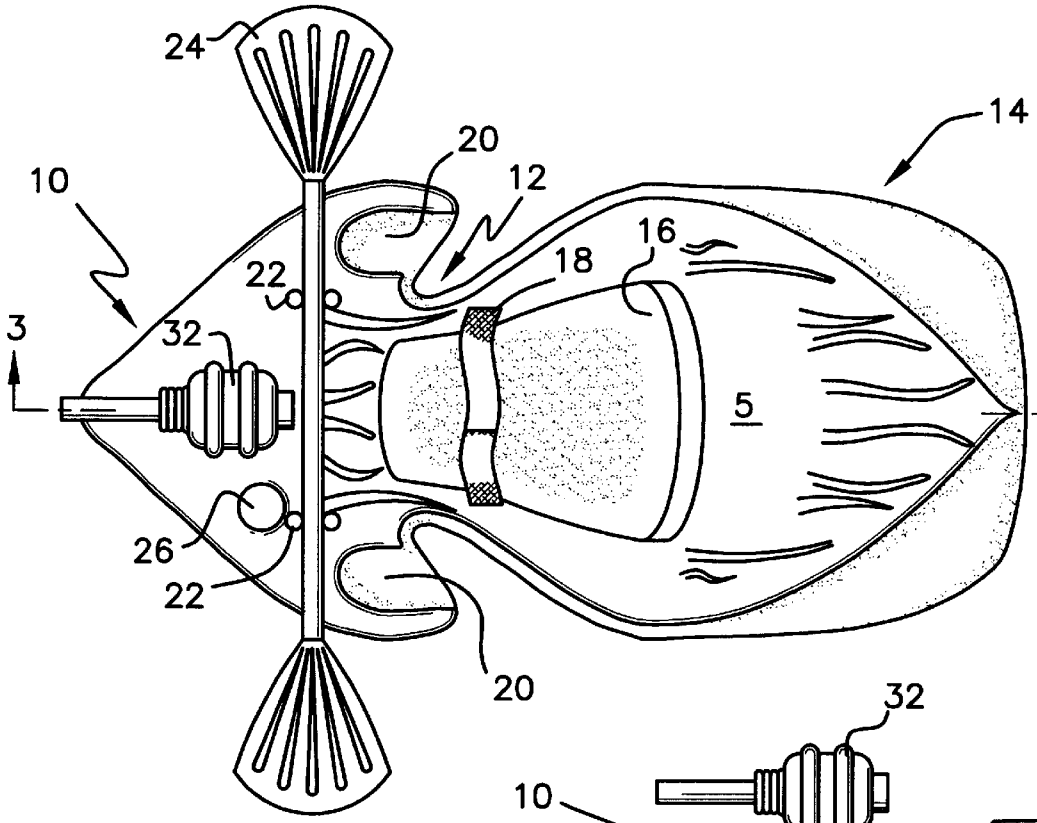
FIG. 1 is a plan view of the invention.
Figure 2:
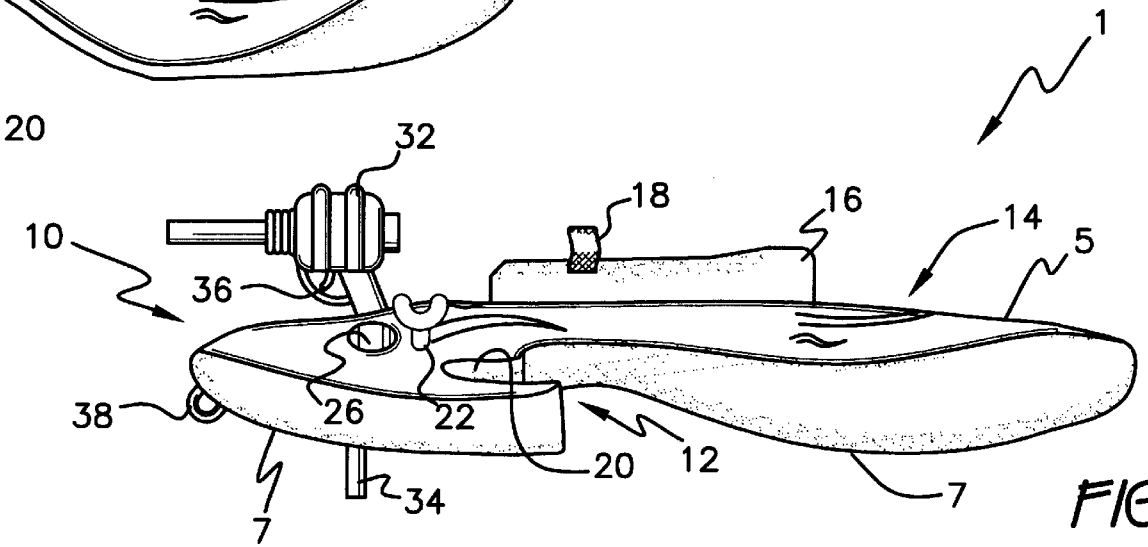
FIG. 2 is a side elevational view of the invention.

Referring now to FIG. 1 and FIG. 2, paddle board 1 is divided into three distinct regions, forward body 10, neck 12 and aft body 14. Forward body 10 is shaped much like the head of a harpoon, flaring out from a pointed tip at the bow before cutting back in toward a lateral center line to form the "barbs" of the harpoon's head. Between the "barbs" of head 10 is a narrower neck 12, from which the body flares back out to form aft body 14, which could be described as the shaft of the harpoon, having approximately the same width as forward body 10.

Mounted to the upper surface 5 of paddle board 1, beginning at neck 10 and continuing onto the front portion of aft body 14 is a padded seat 16, with safety strap 18. Molded into the rear portion of the "barbs" of forward body 10 are stirrups 20. A rider sitting on seat 16 can comfortably let his legs hang into the water in the narrow area of paddle board 1 at neck 12 or place his feet into stirrups 20.

Paddle clips 22 are removably mounted on the upper surface 5 of forward body 10 to receive a paddle 24 when it is not in use. Molded into the upper surface 5 of forward body 10 is cup holder 26 for receiving a drink container (not shown).

Figure 3:
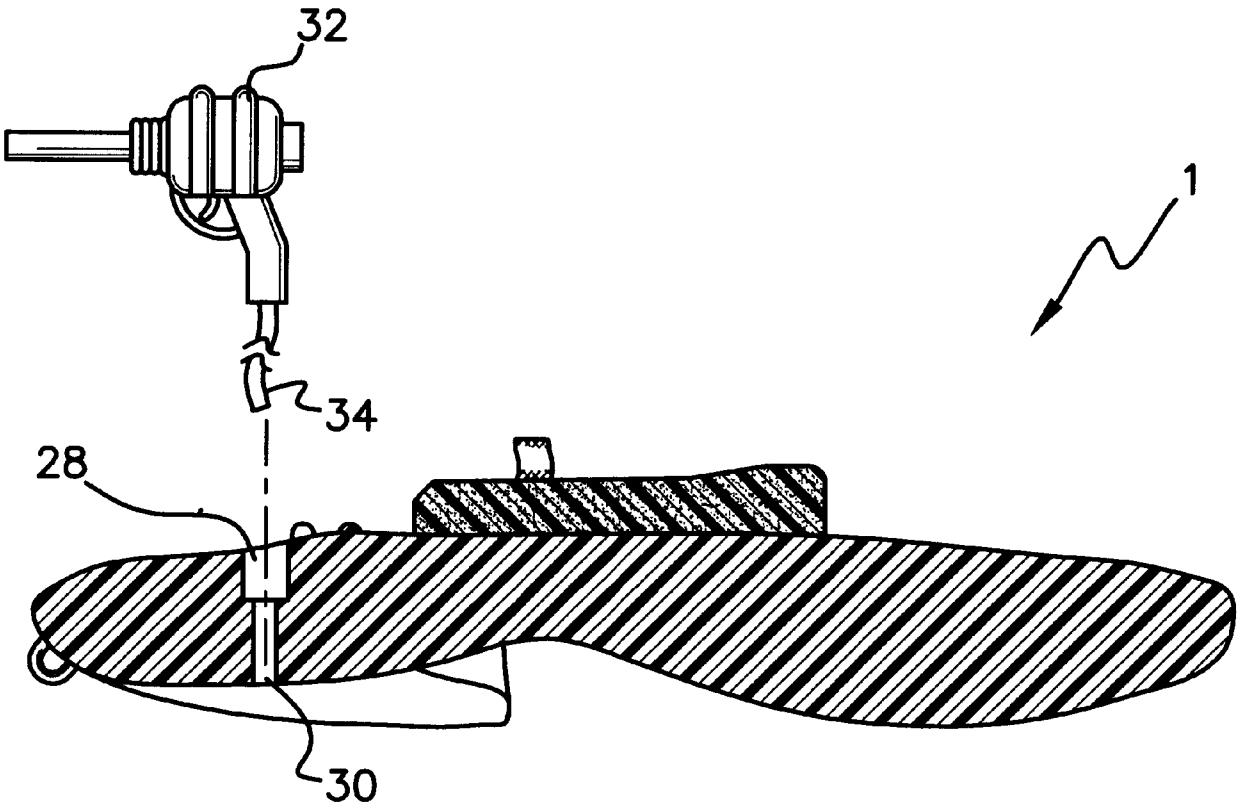
FIG. 3 is partial cut away view of the invention at line 3—3 of FIG. 1.

Referring now to FIG. 3, also molded into the center of the upper surface 5 of forward body 10 is accessories mount 28, with water supply channel 30 penetrating forward body 10 from the bottom of accessories mount 28 through lower surface 7 of forward body 10. The stock of water gun 32 mounts into accessories mount 28 with water supply tube 34 of water gun 32 extending through water supply channel 30. Water is drawn from the body of water below paddle board 1, through water supply tube 34, and out of water gun 32 by pulling trigger 36, activating a pumping action within water gun 32.

Paddle board 1 can be pulled by a boat (not shown) by attaching a rope (not shown) through tow ring 38 or by the rider holding the rope, as in water skiing. Pommel 18 keeps the rider from sliding forward on seat 16 when being towed while holding the tow rope (not shown).

It would be evident to one skilled in the art that paddle board 1 could be made of a variety of materials such as fiberglass or a poly-carbonate over a foam core. It would be further evident to one skilled in the art that paddle board 1 could be manufactured in a variety of sizes to accommodate riders from youth to adult. Again, it would be evident to one skilled in the art that other items, such as a tackle box, could be mounted to accessories mount 28.

It is to be understood that the present invention is not limited to the embodiments described above, but encompasses any and all embodiments within the scope of the following claims.

What is claimed is:

1. A paddle board comprising;

a body, further comprising a forward body portion having a generally pointed bow, symmetrically tapering outwardly to form the width of said paddle board, a narrower neck portion, symmetrically tapering back toward the centerline of said paddle board, and an elongate, aft body portion, symmetrically tapering back to the full width of said paddle board, and a seat upon which a rider may sit, centered laterally on the upper surface of said body and running from said neck portion onto said aft body portion, and a pair of stirrups into which a rider may place his feet while sitting on said seat, one molded into each side of the rear portion for said forward body portion which extends out from said neck portion.

2. A paddle board, as defined in claim 1, wherein said seat is a padded seat affixed to said neck portion and aft body portion.

3. A paddle board, as defined in claim 2, wherein said seat includes a safety strap running laterally across said seat and raised from the upper surface of said seat to restrain a rider from sliding forward on said seat when in a kneeling position.

4. A paddle board, as defined in claim 1, wherein a pair of paddle clips is mounted on said upper surface of said forward body portion to receive and store a paddle when said paddle is not in use.

5. A paddle board, as defined in claim 4, wherein said paddle clips are removably mounted.

6. A paddle board, as defined in claim 1, wherein a cup holder is formed into said upper surface of said forward body portion.

7. A paddle board, as defined in claim 1, wherein a tow ring is molded into the front portion of said forward body portion.

8. A paddle board, as defined in claim 1, wherein an accessory mount is molded into said upper surface of said forward body portion, and a water supply channel passes from the bottom of said accessory mount, through said forward body portion, exiting through the lower surface of said forward body portion.

9. A paddle board, as defined in claim 8, wherein a water gun is mounted in said accessory mount, a water supply tube running from said water gun extends through said water supply channel to supply water from the body of water below said paddle board to said water gun, by suction, when the trigger of said water gun is pulled.

10. A paddle board comprising;

a body, further comprising a forward body portion having a generally pointed bow, symmetrically tapering outwardly to form the width of said paddle board, having a pair of paddle clips mounted on the upper surface of said forward body portion to receive and store a paddle when said paddle is not in use, a cup holder formed into said upper surface, a tow ring molded into the front portion of said forward body portion, accessory mount molded into said upper surface, with a water supply channel passing from the bottom of said accessory mount, through said forward body portion, exiting through the lower surface of said forward body portion, a water gun mounted in said accessory mount, having a water supply tube running from said water gun, extending through said water supply channel, to supply water from the body of water below said paddle board to said water gun, by suction, when the trigger of said water gun is pulled, and a pair of stirrups into which a rider may place his feet, one molded into each side of the rear portion for said forward body portion which extends out from a narrower neck portion, symmetrically tapering back toward the centerline of said paddle board, and an elongate, aft body portion, symmetrically tapering back to the full width of said paddle board, and having a padded seat upon which a rider may sit, centered laterally on said upper surface of said body and running from said neck portion onto said aft body portion, said seat having a safety strap running laterally across said seat and raised from the upper surface of said seat to restrain a rider from sliding forward on said seat when in a kneeling position.

11. A paddle board, as defined in claim 10, wherein said paddle clips are removably mounted.

12. A paddle board, as defined in claim 10, wherein said body is formed of a poly-carbonate material over a foam core material.

13. A paddle board, as defined in claim 10, wherein said body is formed of fiberglass over a foam core material.

* * * * *